US005737990A

United States Patent [19]

Freeland et al.

[11] Patent Number: 5,737,990

[45] Date of Patent: Apr. 14, 1998

[54] APPARATUS FOR MAKING MITER JOINTS

[76] Inventors: Brian Ellison Freeland, 2 Elm Drive, Sunbury-on-Thames, Middlesex TW16 5NX; Neil Freeland, The Flat 8 The Avenue, Sunbury-on-Thames, Middlesex TW16 5HS; Stuart Freeland, 42 Acacia Avenue, Shepperton, Middlesex TW17 0AY, all of England

[21] Appl. No.: 545,652

[22] Filed: Jan. 17, 1996

[51] Int. Cl.[6] ..... B27B 27/06; B27G 5/02

[52] U.S. Cl. ..... 83/767; 83/468.3; 83/471.2; 83/522.17; 83/522.25; 83/581; 83/574; 33/465; 33/534; 33/641

[58] Field of Search ..... 83/468.3, 468.7, 83/473, 581, 761, 762, 764, 767, 522.17, 522.25, 471.2, 574; 269/303, 315, 319, 41, 42, 295; 33/452, 455, 465, 471, 534, 538, 640, 641

[56] References Cited

U.S. PATENT DOCUMENTS

| | | | |
|---|---|---|---|
| 1,247,758 | 11/1917 | Watson, Sr. | 269/42 X |
| 2,046,404 | 7/1936 | Owen | 83/767 |
| 3,498,345 | 3/1970 | Sexton . | |
| 3,709,266 | 1/1973 | Fusco | 83/761 |
| 4,218,947 | 8/1980 | Laviola | 83/762 |
| 4,350,066 | 9/1982 | Volk | 83/581 X |
| 4,455,908 | 6/1984 | Keddie . | |
| 5,473,821 | 12/1995 | DiMarco | 83/522.17 X |

FOREIGN PATENT DOCUMENTS

| | | |
|---|---|---|
| 1245535 | 11/1988 | Canada . |
| 9103189.3 | 7/1991 | Germany . |
| 8101018/3 | 2/1981 | Sweden . |
| 485023 | 5/1938 | United Kingdom . |
| 831361 | 3/1960 | United Kingdom . |
| 1134102 | 11/1968 | United Kingdom . |
| 2185436 | 7/1987 | United Kingdom . |
| 2208624 | 4/1989 | United Kingdom . |
| 2261189 | 5/1993 | United Kingdom . |

*Primary Examiner*—Eugenia Jones
*Attorney, Agent, or Firm*—Leo Zucker

[57] ABSTRACT

Miter joint cutting apparatus includes a base, and an adjusting member mounted on the base for relative sliding movement to a position along the direction of a saw line. A workpiece locating mechanism is mounted on the base for angular adjustment with respect to the saw line, and includes a pair of elongate guide boxes wherein each box has a lower lateral wall parallel to the base for supporting a workpiece with a forward end of the wall pivoted to the adjusting member, and a vertical wall extending from the lower wall. The lateral wall is coupled to the base via a projection which slides in a lateral slot in the base, as the guide box is moved by operation of the adjusting member. The forward end of the lateral wall is shaped so that an adjustment gap is defined between the forward end and the saw line over a range of angular adjustment settings for the guide boxes wherein the boxes pivot symmetrically over the range of settings relative to the saw line, including settings to either side of one where both boxes are perpendicular to the saw line. Accordingly, either an internal or an external miter angle cut can be defined by a guide box for a workpiece clamped in one position in the box.

14 Claims, 6 Drawing Sheets

APPARATUS FOR MAKING MITER JOINTS

BACKGROUND OF THE INVENTION

1. Field of the Invention

This invention relates to apparatus for use to enable cutting of mitred joints.

It is particularly but not exclusively concerned with such an apparatus having means for adjustably setting guides for the mitre in order to accord to a template which is settable to conform to the angle required for the mitre.

2. Discussion of the Known Art

In cutting a mitre joint it has often been the practice to employ a mitre box which has saw guides and fixed angles to produce a mitred joint of a correspondingly fixed angle For example mitred joints at the corners of a rectangular frame would be cut at an angle of 45°.

Mitred joints for other than rectangular frames would need either a separate mitre box for each angle or else a saw guide adjustable with respect to the mitre box In the latter case the saw line or line of cut requires re-setting for the angle of the co-operating adjacent frame part.

In some cases each mitre joint is different from a previously cut joint e.g. in the case of cutting mitred joints in coving to fit around the wall/ceiling joint in a room the fact that the room may not be square either by accident or design, means that often each corner mitred joint is different from the others.

There is disclosed in U.S. Pat. No. 3,498,345 (Sexton) a combined saw mount, preferably for a power saw, and a mitering device. A slide or carriage 12 is disposed in a slideway 11 and controlled by a screw 13 so as to steplessly adjust the angular position of a pair of guide plates 17 each in the form of a plate or strip disposed upright on its edge and resting on the base plate or table 10. The guide plates 17 are pivotally connected to carriage 12 at their inner ends by respective hinge pins 18 and are pivotally connected intermediate their ends to a pin and slot device 20, 21, whereby stepless lengthwise movement of carriage 12 in slideway 11 causes corresponding angular movement of guide plate 17 to vary the angle of mitering cut, by a lever type action. The disc-type power saw is mounted for pivotal movement in an arc to a point of cut between the hinge pins 18 where the narrow strip section workpiece is cut.

A shortcoming of the disclosure in the above-mentioned Sexton specification lies in its inability to permit workpieces other than extremely narrow ones to be cut with a full width mitred face in one cutting operation. The mode of connection of guide plate 17 to carriage 12 by means of vertical hinge pins 18 at the inner ends of the guide plates means that, as can be seen in FIG. 1, a workpiece inserted into the apparatus and caused to slide along one of the guide plates towards the cutting plane will engage the guide plate and/or hinge pin on the other side of the apparatus before it reaches the position in which a single mitred cut at the chosen angle can be made. The result is that a series of cuts have to be made before the required one has been achieved.

There is disclosed in Swedish specification P6707 dated 13.02.81 (Nilsson) a mitre box device having pivoted arms to receive workpieces. A mechanism for simultaneously adjusting the angular attitude of the arms is provided. This enables a very limited range of swivelling movement of the arms 21 by means of rolling movement of the rounded ends of the arms in complementary recesses 14 provided in the base 10 of the apparatus. Pinions 17 fixed to the inner ends of the arms 21 mesh with each other and synchronize the angular movement of the arms over the very limited angular range seen in FIGS. 1 and 2.

In the Nilsson specification the workpiece is supported in use against a vertical wall having an inner edge positioned, as seen in FIG. 3, so that the wall supports the workpiece right up to the saw line (19) whereby the vertical wall crosses the saw line if an attempt is made to set the apparatus for cutting external mitre angles, whereby the vertical walls either directly engage and foul each other and/or cause workpieces thereon to do so when attempting to cut internal mitre angles across the full width of a workpiece in one cut.

An object of the present invention is to provide apparatus for use in cutting a mitre joint in which the precision of the pivot and slot mechanism disclosed in the Sexton reference in which angular movement of the arms is provided by a slidable carriage is combined with an ability to accommodate internal and external mitering angles and a facility to accommodate relatively wide workpieces and achieve a mitred cut in a single cutting operation.

SUMMARY OF THE INVENTION

In an embodiment, there is provided mitering apparatus in which a slidable carriage is associated with a lever type pivot and slot angular adjustment mechanism. The arms or workpiece supports are pivotally connected to the carriage of the apparatus through respective base plate portions of the arms whereby, in use, workpieces can be inserted over said pivots so as to extend across the intended line of mitering cut before engaging the structure of the other of the two arms or workpiece supports. By providing a thus-modified arrangement for pivotal connection of the arms or workpiece supports to the carriage there is provided mitering apparatus in which two significant improvements are provided with respect to the prior Sexton apparatus, namely the accommodation of both internal and external mitering angles and the accommodation of wider workpieces.

In an embodiment described below there is provided apparatus for use in cutting a mitre joint comprising a base, saw guiding means located to provide a saw line, workpiece locating means, and means whereby the workpiece locating means may be angularly adjusted with respect to the saw guiding means. The apparatus includes two workpiece locating means adjustably mounted symmetrically about the saw line. Each of the workpiece locating means is mounted for pivoting about a fulcrum which is adjustable longitudinally parallel to the saw line. Each of the workpiece locating means is provided with a projection which is slidably located in a transverse slot formed in the base, such that longitudinal adjustment of the fulcrum causes transverse movement of the projection in the transverse slot, such adjustment co-operating to cause angular adjustment of the workpiece locating means. Each fulcrum is located in a slide member is adjustable longitudinally by means of a lead screw co-operating with a lead nut forming part of the slide member and the lead screw may be rotatable by means of a handle located at the end of the lead screw.

In the embodiment, saw guiding means is provided secured to the sliding member and movable therewith. The saw guiding means comprises rollers mounted in pairs towards each end of the slide member, one roller of each pair being positioned symmetrically about the saw line or may comprise a plate mounted in a horizontal plane above the base on columns which are secured to the slide member and the plate is adapted to guide a jig saw. In the latter case the saw guiding means is provided with one or more upstanding lips or tongues to define the path of the jig saw, and a longitudinal slot is provided centrally on the plate through which the saw blade is adapted to pass. Each workpiece locating means comprises a box-like section having a lower lateral or horizontal wall, an upper lateral or horizontal wall, and an upstanding or vertical wall, and the lower horizontal wall is provided with a fulcrum pin about which the workpiece locating means may pivot. A workpiece restraining lip is provided adjacent the lower horizontal wall opposite the vertical wall.

The base of the apparatus may constitute part of a work bench. The apparatus may further include means whereby the angle or disposition of the workpiece locating means is adjustable symmetrically about the saw line to accord to a template which itself is settable to conform to the included angle of the required mitre. The template may comprise a pair of arms hinged together at one end and having means to lock the arms in the desired position and the template may be first set to include an angle at which the workpiece is required to be cut and then utilised to ensure the equivalent setting of the workpiece locating means.

In this arrangement the arms of the template are provided with downwardly depending pegs and the upper horizontal walls of the box-like sections of the workpiece guiding means are formed with holes of substantially the same diameter as the pegs, such that the pegs in the template locate within the holes in the upper walls of the box-like sections when the workpiece locating means are set to the same included angle as the template.

The workpiece guiding means may be adapted for use in fixing together the two components of the mitre which have been prepared using the apparatus of the invention.

In the described embodiments a method of cutting a mitre joint on a workpiece utilises a pair of workpiece locating guides which are adjusted symmetrically about a fixed sawing line to the included angle required for the mitre, a workpiece is located in one of the workpiece locating guides and a saw is passed along the sawing line, a second workpiece is then located in the second workpiece locating guide and the saw passed along the same sawing line, whereby the mitre joint may be accurately cut to conform to the required included angle.

The method includes the use of a template which is adjusted and fixed to accord with the articles to which the workpieces are to conform. Interfitting location elements on the template and the workpiece locating means provide a defined angular relationship therebetween. The template is first set to an angle at which the workpiece is to be cut and is then utilized to ensure the equivalent setting of the workpiece locating means.

The above and other features of the invention will become clear from the following description which is given by way of example only with reference to the accompanying drawings.

DETAILED DESCRIPTION OF THE INVENTION

Figure 1:
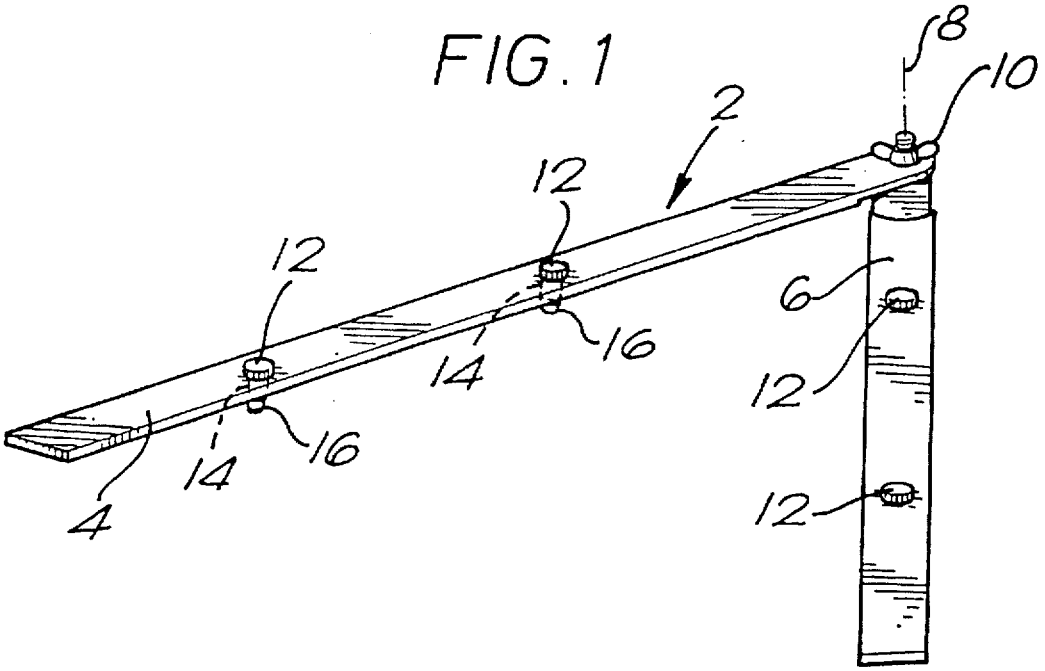
FIG. 1 is a perspective view of a template forming part of the invention.
Figure 2:
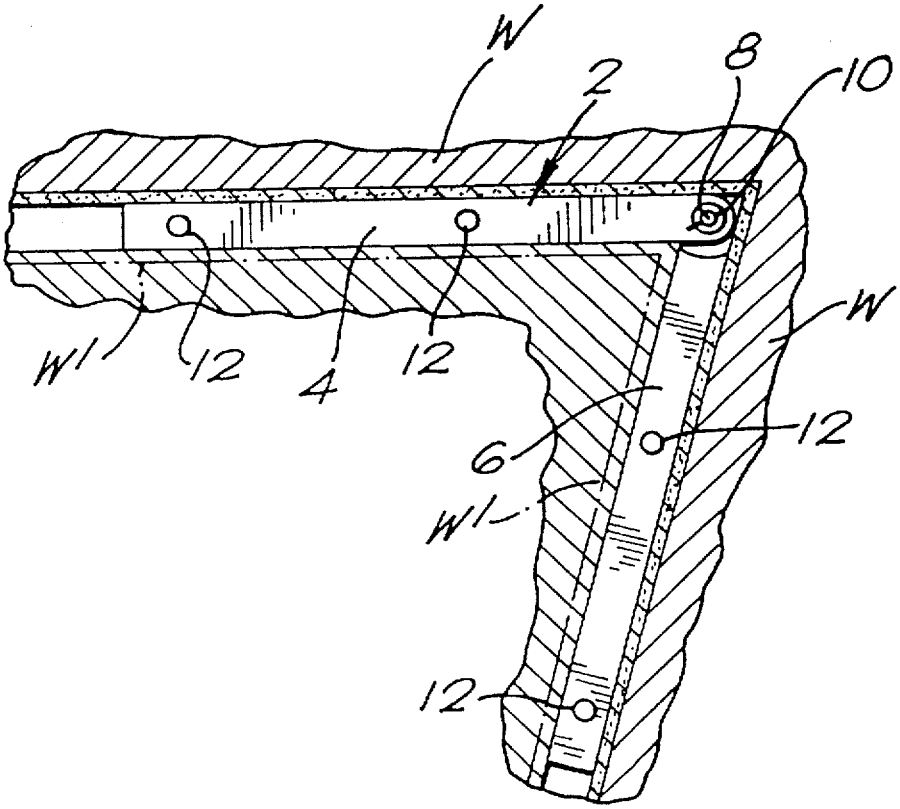
FIG. 2 is a plan view of the template in use to determine angle of a joint between the two conjoined walls of part of a building.

In FIGS. 1 and 2 there is shown a template 2 which comprises arms 4, 6 hinged about an axis 8 and adapted to be clamped together by a screw and wing nut 10. Each arm has secured thereto and depending downwardly therefrom a pair of pegs 12 each formed with a cylindrical shank 14 and a tapered lead portion 16.

In FIG. 2 the template is shown set at an angle to coincide with the angle between a pair of conjoined walls W. To arrive at such a setting, the screw and wing nut device is loosened and the template is offered up to the walls, opened until the arms are in continuous contact with both walls after which the wing nut is re-tightened and the template removed. A pair of conjoined walls $W^1$ are also indicated by chain lines, and which form a reflex or external angle. Thus the template may be adjusted to conform to internal and external angles.

Figure 8:
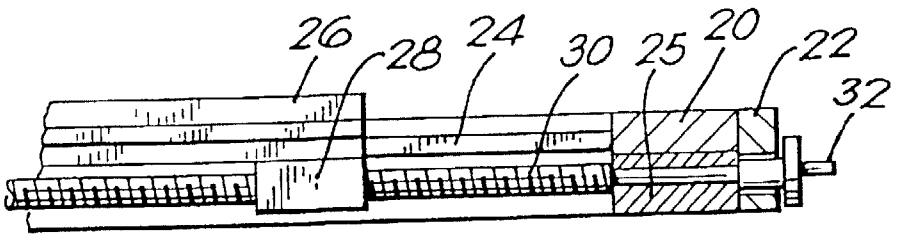
FIG. 8 is a section on the line VIII—VIII of FIG. 4.

As seen in FIGS. 3 to 7 a mitering device 18 comprises a base board 20 mounted within a frame 22. A Tee-slot 24 is formed in the base board 20 and an adjusting member 26 is slidable longitudinally within that Tee-slot. The member 26 is retained within the confines of the slot by capping pieces 28 and 29 secured to the underside of the forward and rearward ends of the member respectively. The forward capping piece 28 is threaded internally to act as a lead nut in co-operation with a lead screw 30 which passes through a plain hole in the frame 22 and is fixed to a handle 32. A horizontally split capping piece 25 seen clearly in FIG. 8 prevents any longitudinal movement of the screw 30 with respect to the frame as the screw is rotated. Alternatively, a simple circlip arrangement may be used, locating in a groove formed on the periphery of the lead screw in known manner and acting on the inside surface of the frame 22 to locate the screw in the same manner. Rotation of the handle 32 clockwise or anti-clockwise will cause the member 26 to move forwardly or rearwardly within the slot 24.

Workpiece locating means in the form of a pair of guide boxes 34 are each formed with an upper lateral wall 36, an outer upstanding wall 38 and a lower lateral wall 40 and a shank portion of a bolt 42 passes through a hole 44 formed in the lower wall 40. The bolts also pass through transverse slots 46 in the base board 20 and are slidable therein. Each bolt 42 is formed with a hexagon head 43 and a hexagon nut 45 is threaded on to the lower end of the bolt. One flat of the nut is restrained from twisting about the axis of the bolt by a rib 51 formed on the underside of the base board 20. Each guide box 34 is mounted for pivoting about the axis of a pivot pin 47 which is fixed e.g. by welding to the forward end portion of the lower wall 40 and is freely pivotable in a hole formed in the member 26 as seen clearly in FIG. 6. The upper wall 36 of each guide box 34 is formed with two holes 50 and the lower walls 40 terminate at their inner edges with an upstanding lip 49 extending for some distance as seen clearly in FIGS. 4 and 7. The channel formed by the lip 49, lower wall 40 and outer wall 38 is provided with a liner 48, the upper surface of which lies in the same horizontal plane as the upper surface of longitudinal ribs 27 which depend upwardly from the sliding member 26 to define a saw clearance slot 31. The liners are each provided with clearance holes 65 to provide access to the hexagon heads 43 by a suitable ring-spanner or socket spanner.

It will clearly be seen that rotation of the lead screw 30 by means of the handle 32 causes the capping piece 28 and the member 26 attached thereto to move forwardly or rearwardly along its Tee-slot according to the direction of rotation. In so doing, the pins 47 move also forwardly or rearwardly causing the guide boxes to rotate about the shanks of the bolts 42. Due to the restraint of the pins 47 in longitudinal direction of motion, the bolts 42 are caused to slide laterally within the confines of the slots 46, resulting in a change of angle of the guide boxes with respect to the median line of the baseboard, i.e. the line along which the saw cut is made. Thus the line of cutting remains constant while the angle of the guide boxes is simultaneously and symmetrically adjustable with respect to that line.

Figure 3:
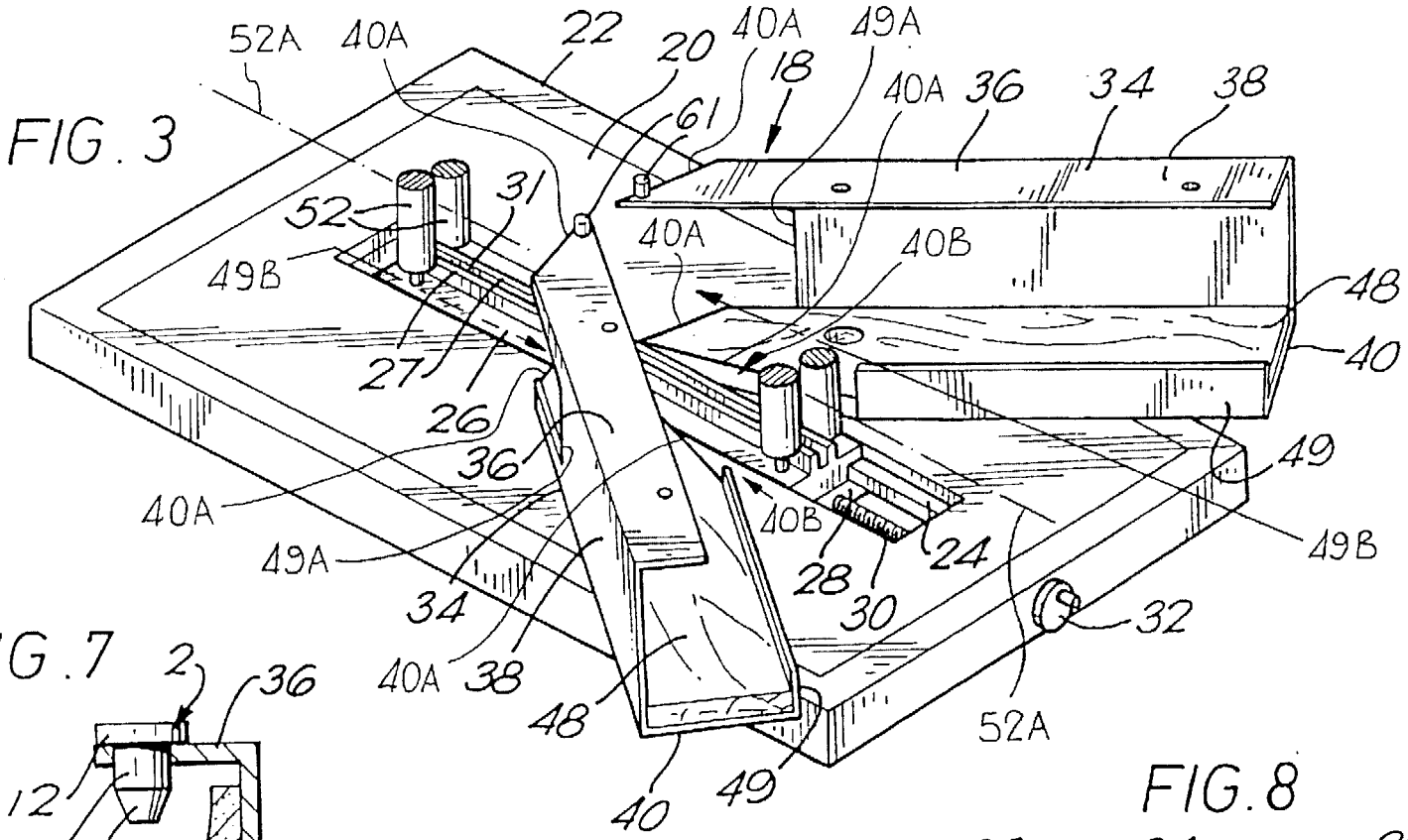
FIG. 3 is a perspective view of an adjustable mitre guide device according to the invention.

Two pairs of roller-type saw guides 52 defining a saw line 52A are rotatably mounted on the member 26, as seen clearly in FIGS. 3, 4 and 5, although an alternative form of saw guide, described later, may be used instead.

The upstanding walls 38 each have an inner edge 49A spaced from the saw line 52A defined by the saw guiding means 52 and from the pivotal connections 47, so that a gap 49B is defined between the edges 49A of the upstanding walls and the saw line. The gaps permit the upstanding walls 38 to be angularly adjusted with the workpiece locating means 34 for enabling cutting internal and external mitre angles without the upstanding wall inner edges 49A crossing the saw line 52A. The gaps 49B also permit a workpiece positioned on one workpiece location means 34, whilst the latter is adjusted for cutting internal mitre angles, to extend over the saw line and through the gap of the other workpiece locating means 34, without being blocked by the upstanding wall 38 of the other workpiece locating means 34.

In use, after the template has been adjusted and set to the angle between the walls W or $W^1$ as described earlier with respect to FIG. 2 it is then taken from the walls and laid on the top surface of the upper walls 36 of the guide boxes 34, the pegs 12 of one arm of the template being gently inserted into the two holes 50 in the top wall of one of the guide boxes. If the pegs in the other arm do not automatically align with the holes in the other guide box, then the handle 32 is rotated to turn the lead screw which causes the member 26 to move longitudinally as described earlier. The pivot pins 47 move with the member 26 and will, if the member 26 is moved towards the front face of the base board, cause the bolts 42 to move outwardly thus spreading the guide boxes 34 and widening the angle therebetween. If the member 26 is moved towards the rear of the base board, then the bolts 42 will move inwardly along the slots 46 and cause the guide boxes to close towards the cutting line symmetrically, thus reducing the included angle between the boxes.

Movement of the member 26 towards the front of the base board causes the bolts 42 to move outwardly along the slots 46 only until the locating boxes are linearly aligned, i.e. at 90° to the saw line or median line. Further movement of the pins 47 with the slide 26 in the same direction causes the bolts 42 to reverse their direction of movement and move inwardly along the slots 46 to rotate the guide boxes about the axes of their pins 47 in order to provide a reflex or external angular setting, i.e. for use where an external angle of the workpiece is to be provided.

Adjustment of the guide boxes in this manner is continued until the pegs 12 align with and penetrate the holes 50, being assisted in this by the lead taper 16 at the lower end of those pegs.

Having thus set the angles of the guide boxes, the bolts 42 are tightened by a suitable ring-spanner or socket spanner on the hexagon heads 43 in order to rigidly lock them in operative position.

Figure 7:
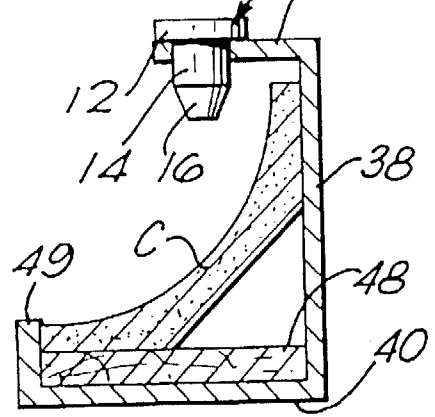
FIG. 7 is a section view on the line VII—VII of FIG. 4 with part of a coving in position for cutting.
Figure 4:
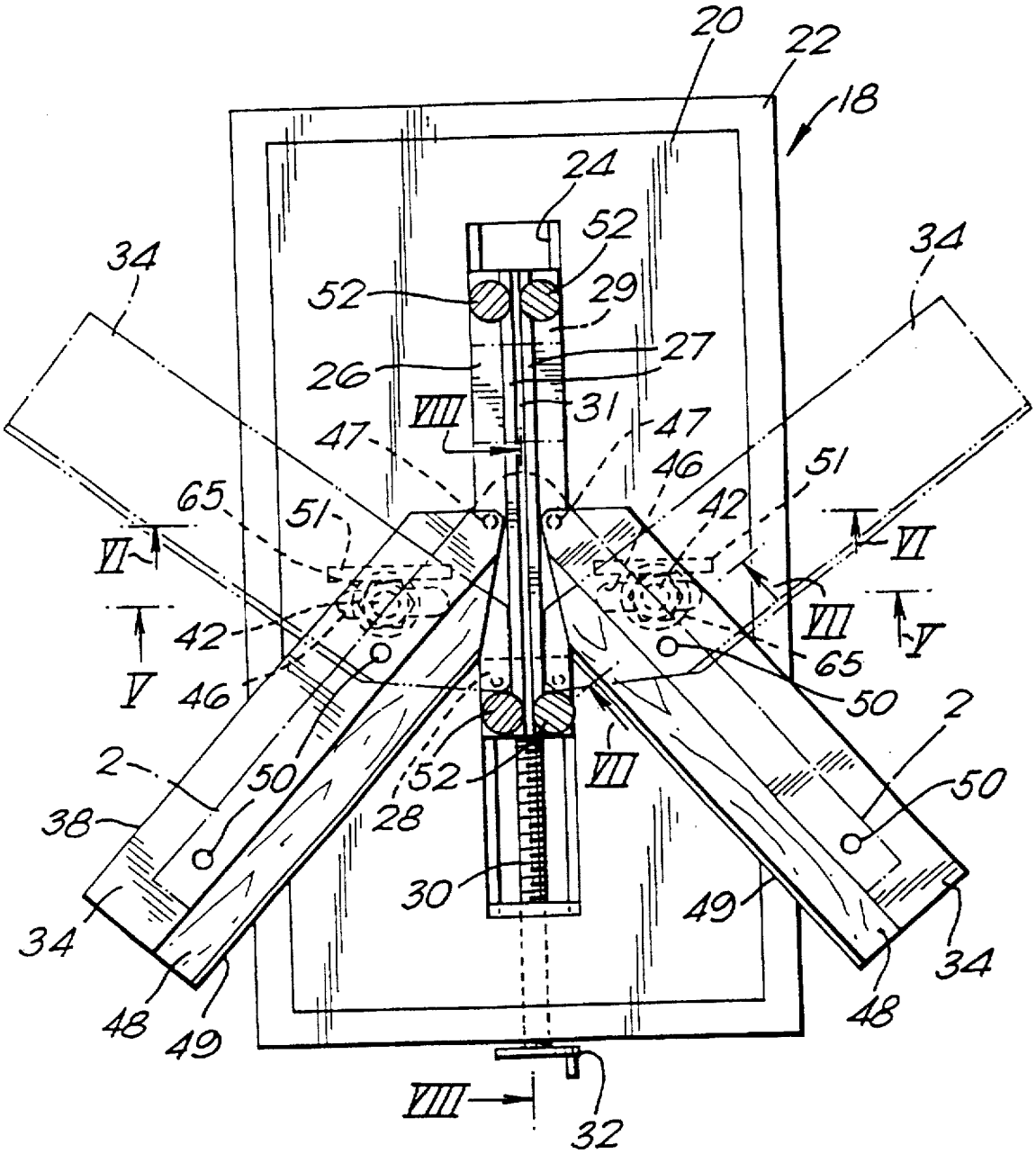
FIG. 4 is a plan view of the device of FIG. 3.
Figure 5:
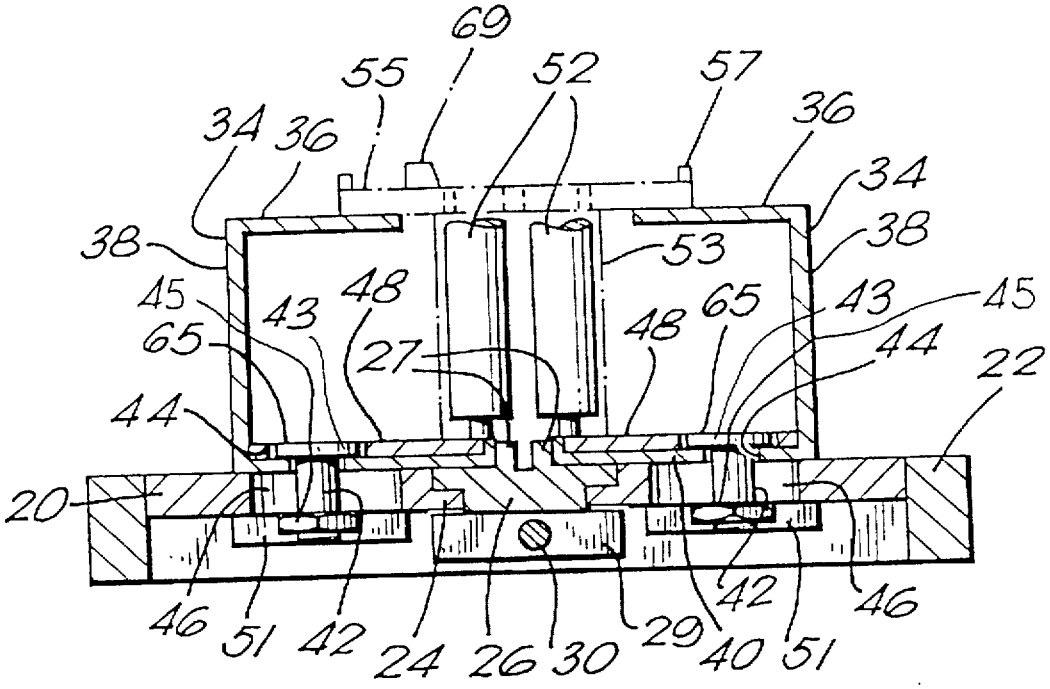
FIG. 5 is a section on the line V—V of FIG. 4.
Figure 6:
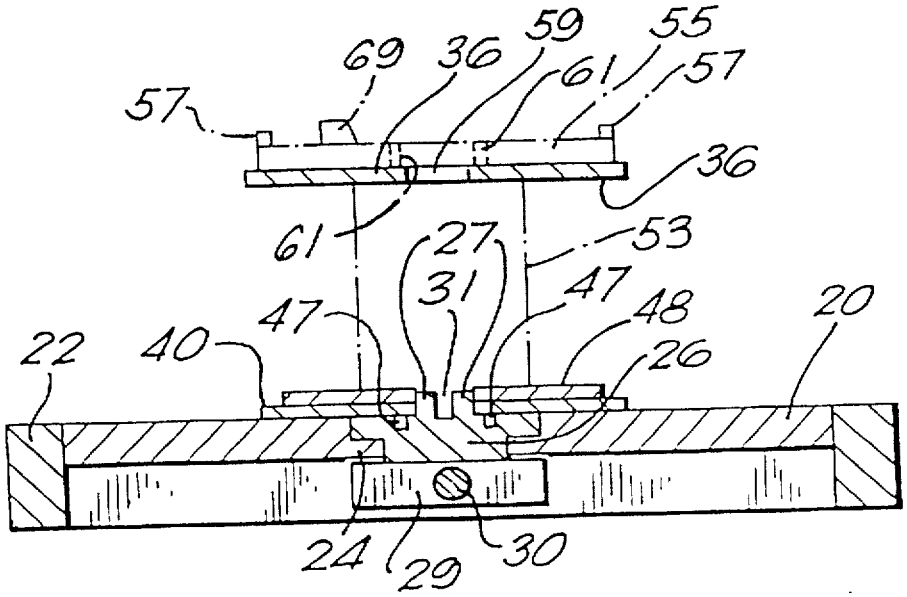
FIG. 6 is a section on the line VI—VI of FIG. 4.

As seen clearly from FIG. 4 the guide boxes are thus set at the same angle as the wall W and the template is then removed. A section of coving C is inserted into one of the guide boxes as indicated in FIG. 7 and is extended therefrom at its foremost end over the median line of the base board. A saw is then guided between the rollers 52 to mitre one end of the coving. The operation is repeated with a further section of coving using the other guide box and the two jointing sections are thus provided with mating surfaces which are appropriate for the angle of conjoined walls.

When smaller sections of coving than that shown in FIG. 7 are being treated, a filler strip of wood is inserted adjacent the upstanding lip 49 in order to ensure that the workpiece maintains its correct angle within the guide box.

In a further arrangement, now shown, the upstanding lip 49 may be extending upwardly beyond that shown in the drawings and a threaded screw passed therethrough to form part of a screw clamp to hold the workpiece firmly against the vertical wall 38 of the guide box.

It is possible to locate the coving in the guide boxes manually during sawing without the need for mechanical clamping means or even the use of the upstanding lip 49 or filler strip, although those arrangements are preferable.

The specific embodiment of the invention has been described with respect to cutting mitres for a coving. It may of course be used for cutting mitre joints for any purpose and in any material, e.g. skirting boards, picture rails, architraves, and picture frames having non-rectangular frames.

Figure 4A:
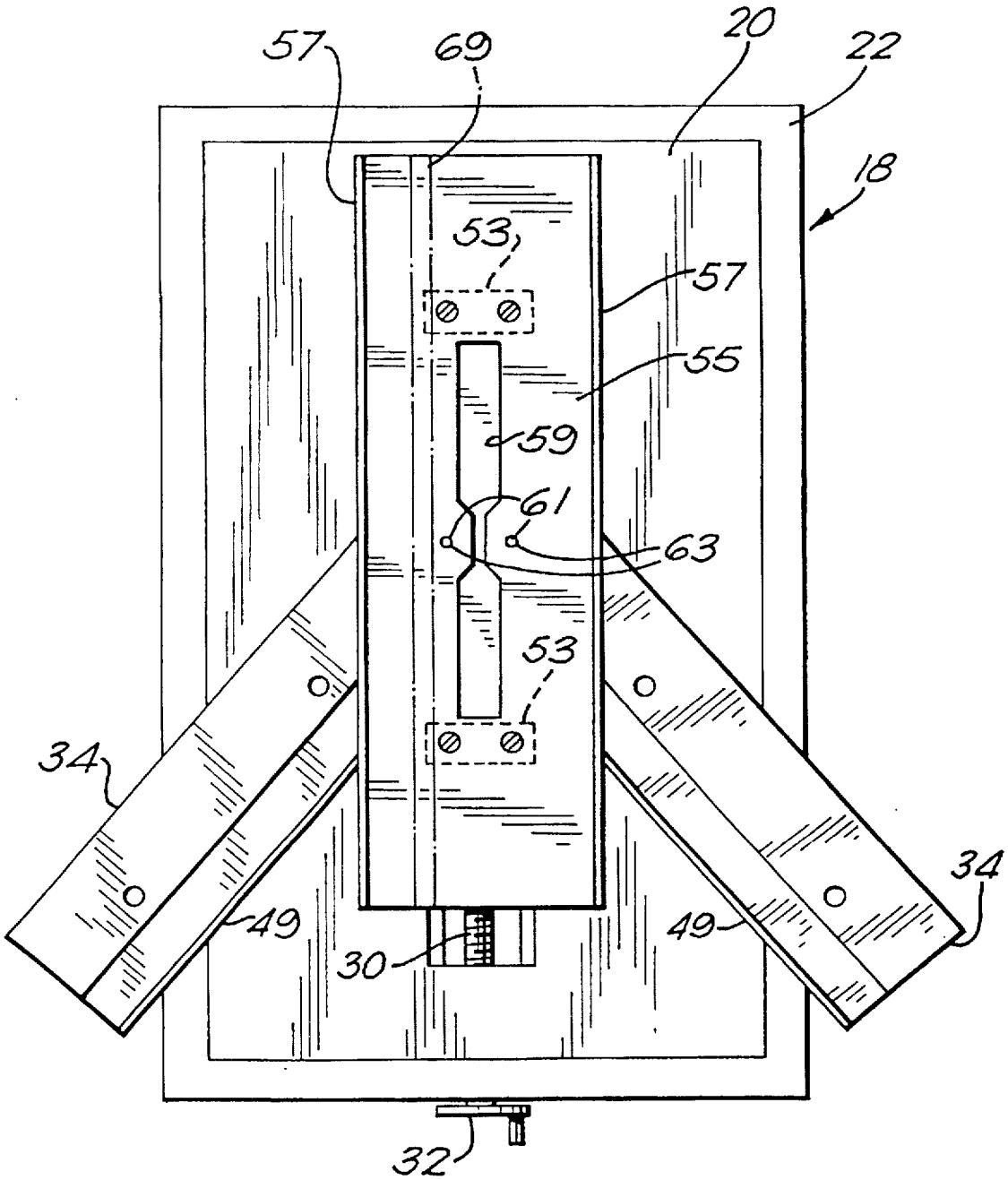
FIGS. 4*a* and 4*b* are alternative embodiments of the device of FIG. 3.

In an alternative arrangement, a power operated jig-saw may be used instead of a conventional hand saw or tenon saw. In such an arrangement shown in FIG. 4*a*, the roller type saw guides 52 are removed and replaced by vertical columns 53 which support a horizontal guide plate 55 extending above the member 26. The guide plate has upstanding lips 57 extending longitudinally along the edges of the plate to provide means for guiding the sole plate of the saw and the vertically reciprocating blade passes through a central slot 59 formed in the guide plate. The guide plate 55 is further stabilised by means of two upstanding pins 61 (see FIG. 3) which locate in suitable holes 63 formed in the guide plate. If so desired, the upper surface of the plate 55 may be provided with one or more longitudinally extending ribs 69 indicated in chain line in FIGS. 4*a*, 5 and 6. The sole plate of the jig saw is provided with suitable matching grooves and the jig saw is then guided along the ribs 69 during cutting of the mitre.

Figure 4B:
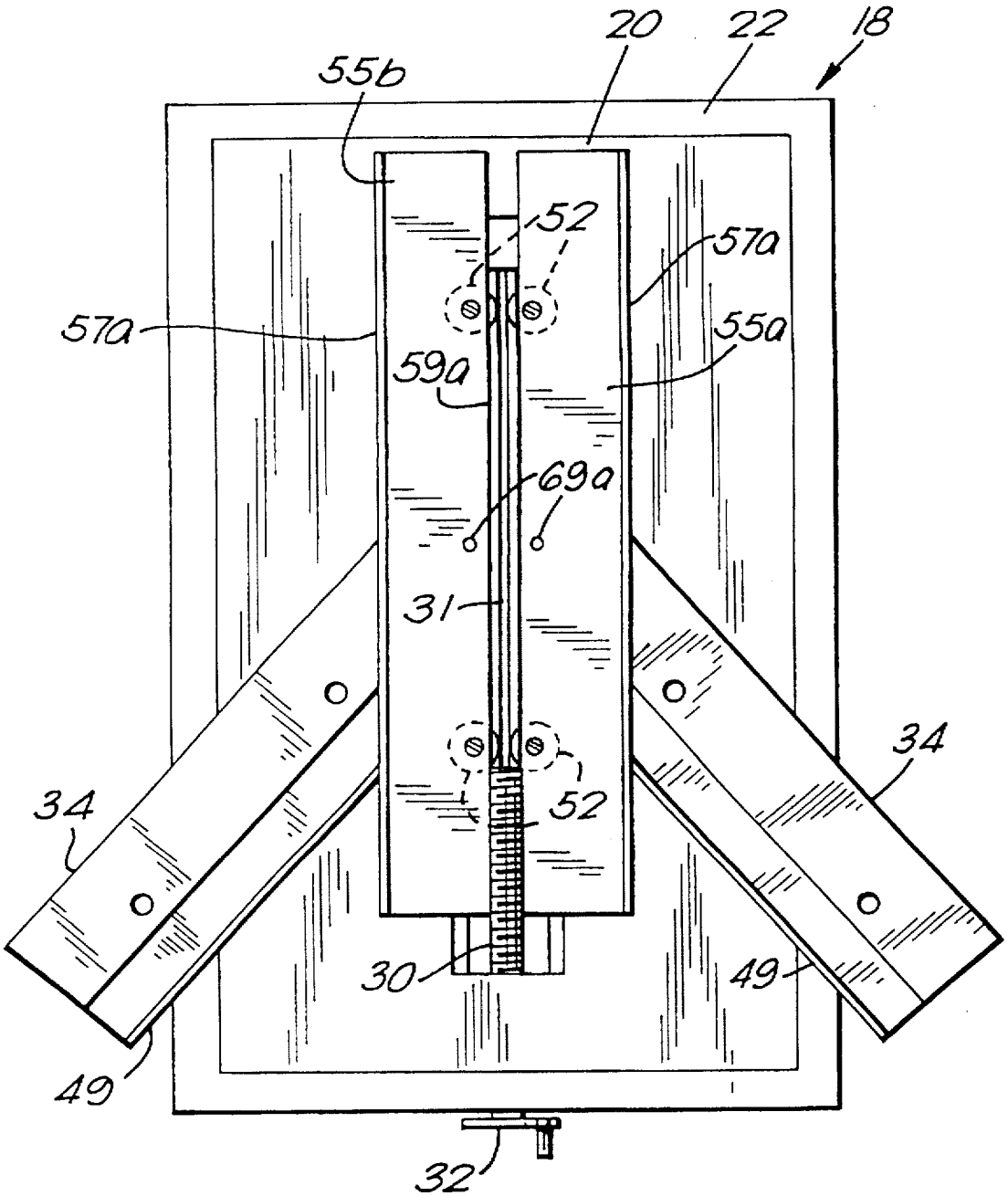

In yet another alternative arrangement shown in FIG. 4*b* the plate 55 is replaced by a pair of half-plates 55*a* and 55*b* each of which is mounted on the top of spindles on which the saw guide rollers 52 are rotated. The inwardly facing edges of the half-plates define a longitudinal slot 59*a* through which the saw is passed in operation and the pins 61 project upwardly from the upper surface of the walls 36 of the guide boxes through holes 69*a* in the half-plates. The half-plates have upstanding lips 57*a* at their outer edges.

Although the above non-limiting example shows and describes saw guiding means attached to the member 26, such guide means may, without departing from the invention, be attached to the base board instead.

In the above arrangement the saw used may be a hand saw or a jig saw guided between the lips 57*a*. Alternatively a circular saw may be used in a similar manner to a jig saw, its sole plate being guided by the lips 57*a*.

FIG. 4 illustrates the setting of the guide boxes in full lines for cutting a mitre for an internal angle. It is obvious that by simply adjusting the guide boxes by means of the lead screw 30 the same apparatus can be used for external mitres. The position of the guide boxes when adjusted for cutting a mitre for an external angle is indicated in chain lines.

The guide boxes, having been set symmetrically to the required angle of the mitre, may be used for the purpose of gluing or otherwise fixing together the two components of the mitre.

The base board 20 is illustrated in the drawings as being mounted within a frame 22. However, the base board and frame could be combined as a one-piece moulding of metal, e.g. aluminum, or of a rigid plastic material.

If desired the upper face of the base board may be provided with markings or graduations in the form of a protractor to allow manual setting of the guide boxes without resorting to the use of a template.

In an alternative arrangement, not shown, the base board may be part of, or may constitute the working surface of a work bench. It is found to be particularly useful when it is part of a portable work bench of the type readily available from Black & Decker Limited.

We claim:

1. Mitre joint cutting apparatus, comprising:

a base;

an adjusting member mounted on said base for sliding movement relative to said base to a desired position along the direction of a saw line;

a saw guide mounted above said base for guiding a saw along the saw line when making a mitre cut in a workpiece; and a workpiece locating mechanism mounted on said base to be adjustable angularly with respect to said saw line;

said workpiece locating mechanism comprising a pair of elongate guide boxes wherein each guide box comprises a lower lateral wall substantially parallel to said base for supporting a workpiece, said lower lateral wall having a forward end connected to the adjusting member for pivotal movement about a pivot axis, and an upstanding wall extending substantially perpendicular from said lower wall;

wherein the lower lateral wall of each guide box is coupled to the base via a projection on one of said lower wall and said base and a slot in the other of said lower wall and said base to guide the projection for relative sliding movement in the slot, and the forward end of said lower lateral wall is shaped so that an adjustment gap is defined between edges of said forward end and said saw line over a range of angular adjustment settings for the guide boxes so that the guide boxes pivot simultaneously and symmetrically over said range of angular adjustment settings with respect to said saw line by operation of said adjusting member, said settings including an aligned setting at which the guide boxes are perpendicular to the saw line, and settings at either side of said aligned setting at which the guide boxes define a desired internal or external mitre angle cut for a workpiece supported in one position on one of the guide boxes; and said upstanding wall of each guide box terminating at an inner vertical edge that is spaced radially outward from the pivot axis of the guide box to define a workpiece clearance gap between the inner edge of said upstanding wall and the pivot axis, and wherein said workpiece clearance gap is of sufficient size so that each of the inner vertical edges of the upstanding walls of the guide boxes remains on the same side of said saw line as the guide boxes are adjusted over said range of angular adjustment settings to enable cutting internal and external angles, and a workpiece supported on one of the guide boxes is movable along a longitudinal direction of the box, over said saw line and through the workpiece clearance gap of the other guide box without interference by the upstanding wall of the other guide box.

2. Mitre joint cutting apparatus according to claim 1, wherein the forward ends of the lower lateral walls of said guide boxes are so shaped that said ends cooperate to define a limit position of pivotal movement of the guide boxes with respect to said adjusting member.

3. Mitre joint cutting apparatus according to claim 1, wherein the upstanding wall of each guide box extends from one elongate edge of said lower wall.

4. Mitre joint cutting apparatus according to claim 1, wherein each guide box has an upstanding lip extending from a long side of the lower lateral wall opposite said upstanding wall, so that a workpiece is supported on the guide box between the upstanding lip and the upstanding wall of the guide box, and the guide box pivots about its pivot axis in either angular direction of said aligned setting to cut this workpiece at either of an internal or an external mitre angle.

5. Mitre joint cutting apparatus according to claim 1, including an angularly adjustable template having arms for defining a mitre angle to be cut by the apparatus, and means for connecting the template to said workpiece locating mechanism to provide a defined angular relation between the template and the workpiece locating mechanism.

6. Mitre joint cutting apparatus according to claim 5, wherein said template has pivot means having a pivot axis for allowing the arms of the template to pivot with respect to one another, wherein said pivot axis coincides with said saw line when the template is used to define an angular setting of the workpiece locating mechanism.

7. Mitre joint cutting apparatus according to claim 5, including and clamping means for enabling a determined angular relation between said arms of said template to be preserved.

8. Mitre joint cutting apparatus according to claim 1, wherein said saw guide comprises a pair of guide members mounted at each end of said adjusting member, and each pair of guide members is positioned symmetrically about said saw line.

9. Mitre joint cutting apparatus according to claim 1, wherein said saw guide comprises a pair of half plates that define a long slot to guide a jigsaw.

10. Mitre joint cutting apparatus according to claim 1, wherein said saw guide is mounted on said adjusting member for slidable movement therewith along the direction of said saw line.

11. Mitre joint cutting apparatus comprising:

a base;

an adjusting member mounted on said base for sliding movement relative to said base to a desired position along the direction of a saw line;

a saw guide mounted above said base for guiding a saw along the saw line when making a mitre cut in a workpiece; and a workpiece locating mechanism mounted on said base to be adjustable angularly with respect to said saw line;

said workpiece locating mechanism comprising a pair of elongate guide boxes wherein said guide box comprises a lower lateral wall substantially parallel to said base for supporting a workpiece, said lower lateral wall having a forward end connected to the adjusting member for pivotal movement about a pivot axis, and an upstanding wall extending substantially perpendicular from said lower wall;

wherein the lower lateral wall of each guide box is coupled to the base via a projection on one of said lower wall and said base and a slot in a the other of said lower wall and said base to guide the projection for relative sliding movement in the slot, and the forward end of said lower lateral wall is shaped to that an adjustment gap is defined between edges of said forward end and said saw line of a range of angular adjustment settings for the guide boxes so that the guide boxes pivot simultaneously and symmetrically over said range of angular adjustment settings with respect to said saw line by operation of said adjusting member, said settings including an aligned setting at which the guide boxes are perpendicular to the saw line, and settings at either side of said aligned setting at which the guide boxes define a desired internal or external mitre angle cut for a workpiece supported in one position on one of the guide boxes; and said upstanding wall of each guide box terminating at an inner vertical edge that is spaced radially outwardly from the pivot axis of the guide box to define a workpiece clearance gap between the inner edge of said upstanding wall and the pivot axis, and wherein said workpiece clearance gap is of sufficient size so that each of the inner vertical edges of the upstanding walls of the guide boxes remains on the same side of said saw line as the guide boxes are adjusted over said range of angular adjustment settings to enable cutting internal and external angles, and a workpiece supported on one of the guide boxes is movable along a longitudinal direction of the box, over said saw line and through the workpiece clearance gap of the other guide box without interference by the upstanding wall of the other guide box;

wherein each guide box of said workpiece locating mechanism comprises an upper lateral wall extending substantially perpendicular from said upstanding wall and over said lower lateral wall so that the guide box has a generally channel-shaped cross section.

12. Mitre joint cutting apparatus according to claim 11, wherein the upper lateral wall of each guide box has first locating means at a radially inner end of the upper lateral wall for engaging a saw guide plate, and said saw guide including an elongate saw guide plate having second locating means for engaging said first locating means, said guide plate being adapted to guide a sole plate of a saw.

13. Mitre joint cutting apparatus according to claim 12, wherein said guide plate is operatively supported in a generally horizontal position, and including column members connected between the guide plate and said adjusting member for supporting the guide plate.

14. Mitre joint cutting apparatus according to claim 12, wherein said guide plate has at least one raised lip for guiding the sole plate of said saw lengthwise of said saw line.

* * * * *